United States Patent [19]

Marsh et al.

[11] 4,361,101

[45] Nov. 30, 1982

[54] POCKET BUTTON ATTACHING DEVICE

[75] Inventors: Walter H. W. Marsh, Scotch Plains, N.J.; William Kahan, New York, N.Y.

[73] Assignee: The Singer Company, Stamford, Conn.

[21] Appl. No.: 275,576

[22] Filed: Jun. 22, 1981

[51] Int. Cl.[3] ..... D05B 3/14; D05B 85/00

[52] U.S. Cl. ..... 112/110; 112/163; 223/102; 227/68

[58] Field of Search ..... 112/110, 104, 111, 112, 112/163; 223/102; 227/68

[56] References Cited

U.S. PATENT DOCUMENTS

| | | | |
|---|---|---|---|
| 549,840 | 11/1895 | Bagby | 246/67 |
| 1,017,247 | 2/1912 | Carson | 112/224 |
| 2,605,943 | 8/1952 | Hoefle | 223/102 |
| 3,404,707 | 10/1968 | Feld | 223/99 X |
| 3,875,648 | 4/1975 | Bone | 29/417 |
| 4,111,347 | 9/1978 | Bone | 227/68 |
| 4,281,782 | 8/1981 | Marsh et al. | 112/110 X |
| 4,296,698 | 10/1981 | Davidson et al. | 112/110 |
| 4,316,562 | 2/1982 | Davidson et al. | 112/110 X |

FOREIGN PATENT DOCUMENTS

| | | |
|---|---|---|
| 1375744 | 6/1936 | Fed. Rep. of Germany . |
| 681147 | 4/1938 | Fed. Rep. of Germany . |

*Primary Examiner*—H. Hampton Hunter

*Attorney, Agent, or Firm*—William V. Ebs; Robert E. Smith; Edward L. Bell

[57] ABSTRACT

A button attaching device is provided with a bifurcated needle holding member which can be utilized to adjust the spacing between a pair of needles, and with a needle cover which attaches to the bifurcated member to protect one from injury by the needles and form a unit that can be conveniently carried on the person of a user.

11 Claims, 6 Drawing Figures

POCKET BUTTON ATTACHING DEVICE

BACKGROUND OF THE INVENTION

The invention is directed to a hand operable device for use in attaching buttons to a layer of fabric or other material.

DESCRIPTION OF THE PRIOR ART

Button attaching aids, of which the device shown and described in U.S. Pat. No. 2,605,943 of A. O. Hoefle issued Aug. 5, 1952, and the apparatus disclosed in U.S. Pat. No. 4,111,347 of Arnold R. Bone issued Sept. 5, 1978 as examples, are well known. In general, the button attaching aids have been difficult to thread, performed unreliably, and were inefficient, or were unduly complex and costly to produce. Recent improvements in button attaching aids are disclosed in Singer owned U.S. Pat. application Ser. No. 145,939 filed May 2, 1980 by Donald R. Davidson et al for "Button Attaching Tool", now U.S. Pat. No. 4,316,562, dated Feb. 23, 1982, Singer's U.S. Pat. application Ser. No. 167,984, filed July 9, 1980 by Donald R. Davidson et al for "Button Attaching Tool with Button Storage Compartment", now U.S. Pat. No. 4,296,698, dated Oct. 27, 1981 and in Singer's U.S. Pat. application Ser. No. 191,962 filed Sept. 29, 1980 by Walter H. W. Marsh et al for "Button Sewing Device", now U.S. Pat. No. 4,281,782, dated Aug. 4, 1981. The present invention is directed to a further improved button attaching device, and has as a primary objective, the provision of a portable button attaching tool which is easily carried on the person of a user, is simple in construction, inexpensive to produce and adaptable for use with variably spaced buttonholes.

SUMMARY OF THE INVENTION

In accordance with the invention, a button attaching device is provided with a bifurcated member having substantially parallel arms which are separated by a gap that can be adjusted by side pressure on the arms. Needles mounted in free end portions of the arms and extending in the same general direction as the arms are moved to vary the spacing therebetween as the gap between the arms is altered. Elastomeric material is secured to the free end of each arm and extends part way up a needle on the arm. A needle cover attaches to the bifurcated member as by way of a threaded connection or friction fit to form a unit that can be conveniently carried on the person of a user. The needle holding member is formed with a rounded bottom end which prevents the member from standing vertically and supporting the needles endwise in potentially injurious positions.

DESCRIPTION OF THE INVENTION

Figure 1:
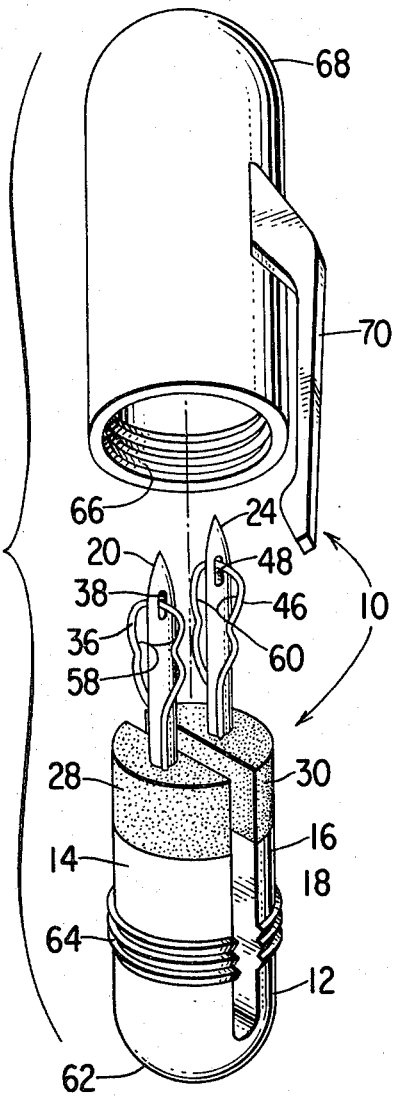
FIG. 1 is a perspective view of a button attaching device according to the invention showing a cover removed from a needle holding member.
Figure 3:
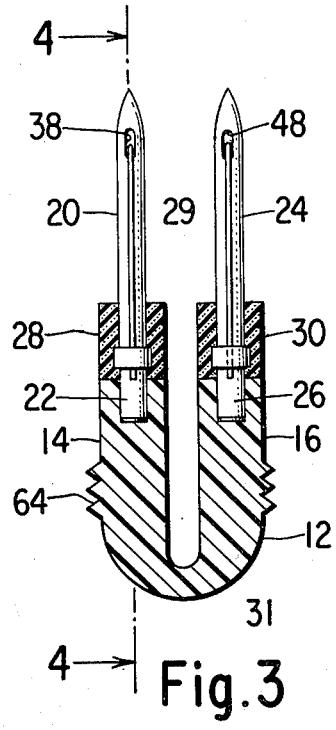
FIG. 3 is a vertical sectional view of the needle holding member taken on a plane extending through a needle pair fixed therein.
Figure 2:
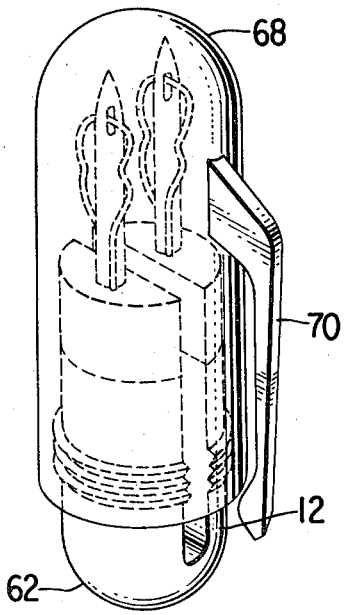
FIG. 2 is a perspective view of the button attaching device of FIG. 1 with the cover in place.
Figure 4:
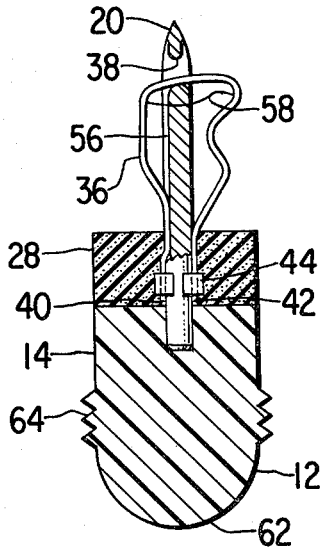
FIG. 4 is a vertical view taken through the needle holding member on the plane of the line 4—4 of FIG. 3.

Referring to FIGS. 1 through 4 of the drawings, reference character 10 designates a portable button attaching device according to the invention including a bifurcated member 12 with substantially parallel arms 14 and 16 which are separated by a gap 18. A needle 20 is affixed at 22 in the free end portion of arm 14, and a needle 24 is affixed at 26 in the free end portion of arm 16. As shown, the needles 20 and 24 extend in the same general direction as the arms. A cap 28 of a readily compressible elastomeric material secured to the free end of arm 14 as with a suitable adhesive, and a like cap 30 of elastomeric material similarly secured to the free end of arm 16 extend part way up the shafts of needles 20 and 24, respectively. The caps 28 and 30 may, for example, be formed of a soft elastomeric plastic foam material, or there may be substituted for each of the caps, an elastomeric shell which although of a less soft material, is designed to render it readily compressible.

Member 12 is of a material, preferably plastic, which is sufficiently resilient to enable the arms 14 and 16 and thereby the needles 20 and 24 to be moved by the application of finger pressure to the sides of the arms from a normal position into a somewhat closer relationship by a narrowing of the gap 18. In this way, the spacing 29 between the needles may be adjusted to permit the needles to enter variously spaced buttonholes. As indicated in the drawings, the cross sectional area of member 12 at 31 where the arms 14 and 16 connect is smaller than elsewhere along the arms. The connection between the arms of a member 12 fashioned as a unitary piece therefor forms a natural hinge permitting adjustment of the needles as described. As an alternative to such a natural hinge there may be provided a spring biased mechanical hinge effective to normally maintain each of a pair of individual arms which have been suitably connected to it in a position with predetermined spacing therebetween but permitting relative movement of the arms for varying the spacing.

The needles 20 and 24 carry loose loops of thread which extend through the eyes of the needles and have ends secured to the needles near the free ends of the arms 14 and 16. As shown, needle 20 carries thread 36 extending through an eye 38 and having ends 40 and 42 secured to the needle with a crimped ring 44. Needle 24 carries a thread 46 which extends through an eye 48 and has ends secured to the needle in the same manner as the ends of thread 20 are secured to needle 20. One side of needle 20 includes a straight thread receiving groove 56 which extends downwardly from eye 38 to a portion of the needle in close proximity to ring 44. Needle 24 includes a like thread receiving groove not visible in the drawings but extending in the same direction as groove 56.

Each of threads 36 and 46 consists of one or more filaments formed of a pliable material enabling loops 58 and 60 formed by the threads 36 and 46, respectively, to be readily collapsed. The filaments may be synthetic or composed of natural fibers. Elastomeric caps 28 and 30 may be foam rubber, a polyurethane plastic, or some other suitable material compressible with finger pressure and capable of returning to its original shape when released.

Member 12 is generally tubular in form and has a rounded bottom end 62 which prevents the member from standing vertically, as on a table for example, and disposing the needles 20 and 24 in a potentially injurious position. Threads 64 are provided on member 12 for engagement with threads 66 on the inside of a cover 68 which protects one from injury by the needles when secured onto member 12. The cover includes a clip 70 by means of which the entire device may be securely held in a pocket.

With the cover 68 removed, the button attaching device 10 is utilized in a manner such as described in U.S. Pat. application Ser. No. 191,962 mentioned hereinbefore to attach a button to a layer of cloth; first by piercing the cloth with the needles 20 and 24, and then with the spacing between the needles suitably adjusted by finger pressure on legs 14 and 16, passing the needles through the holes in a button. Thread bundles are inserted through the loops 58 and 60 and the button attaching device is withdrawn from the button and cloth, after which the thread bundles that have been pulled through the holes of the button and cloth are tied to permanently secure the button to the cloth.

Figure 5:
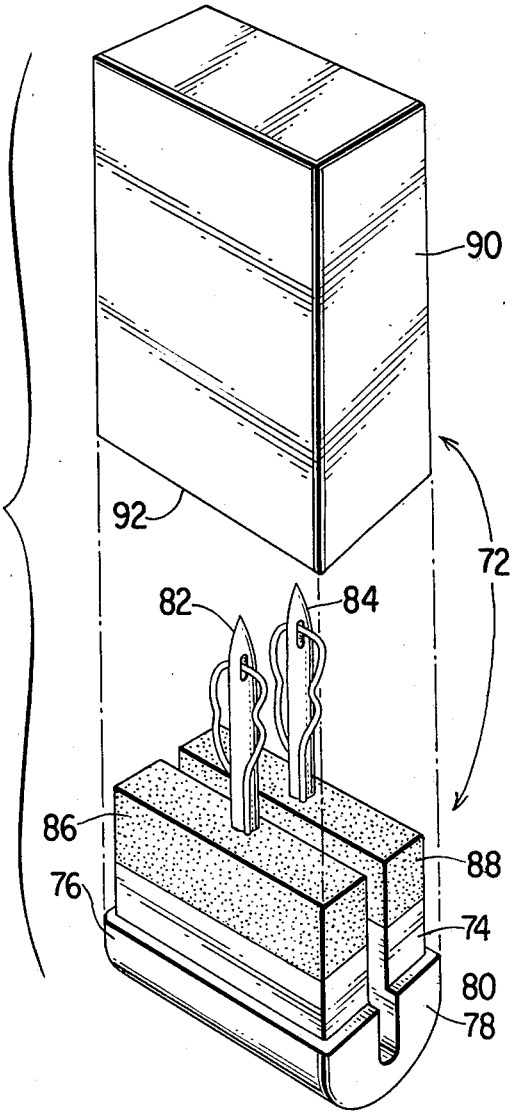
FIG. 5 is a perspective view of a modified form of button attaching device showing a cover removed from a needle holding member.
Figure 6:
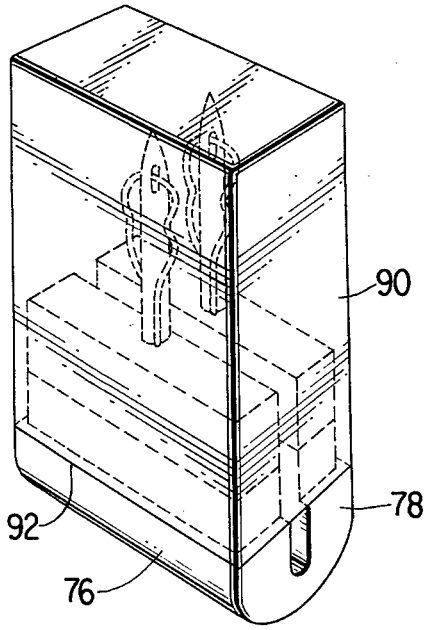
FIG. 6 is a perspective view of the button attaching device of FIG. 5 with the cover in place.

A modified form of button attaching device according to the invention is shown in FIGS. 5 and 6. The modified device which is designated by reference character 72 is similar to the device of FIGS. 1 through 4 in that it includes a bifurcated member 74 with arms 76 and 78 separated by a gap 80, needles 82 and 84 affixed in the arms, elastomeric material surrounding caps 86 and 88 on the arms, and a cover 90 for the needle. However, the arms 76 and 78 along with caps 84 and 88 are formed with rectangular cross sections and the cover 90 is a box-like enclosure with an open bottom end 92. The cover is so dimensioned as to provide for tight fitting engagement of inside surfaces of front, rear and side walls of the cover with front, rear and side surfaces, respectively of the member 74, all sufficient to maintain the cover in a protective position over the needles 82 and 84 until removed to permit utilization of the device in a button attaching operation. With the cover 90 fitted in place over member 74 a neat package is formed which can conveniently be carried on a person in a pocket. Bifurcated member 74 is used to attach a button to a layer of cloth in the same manner as member 12 of FIGS. 1 through 4.

Other forms of the invention than those described are also possible, and it is understood that the embodiments disclosed herein are in no way to be construed as a limitation of the invention. Numerous alterations and modifications of the disclosed structures will suggest themselves to those skilled in the art, and all such alterations and modifications which do not depart from the spirit and scope of the invention are intended to be included within the scope of the appended claims.

We claim:

1. A button attaching device comprising a pair of needles for use in penetrating a layer of material and extending through the holes of a button to be attached to the material; a bifurcated member including a pair of substantially parallel arms each with one of the needles affixed in a free end portion to extend in the same general direction as the arm, and with a gap between the arm adjustable with side pressure on the arms to change the spacing between the needles; and a cover for the needles attachable to the bifurcated member.

2. A button attaching device according to claim 1 with elastomeric material secured to the free end of each arm and extending part way up the associated needle from the arm.

3. A button attaching device according to claim 1 wherein the cover fits tightly over the bifurcated member and is retained on such member by a friction fit.

4. A button attaching device according to claim 1 wherein the cover and bifurcated member are threaded to provide for attachment of the cover to said member by way of a threaded connection.

5. A button attaching device according to claim 1 including a pocket clip on the cover.

6. A button attaching device according to claim 1 wherein the bifurcated member and cover are generally tubular in form.

7. A button attaching device according to claim 1 wherein the bifurcated member and cover are generally rectangular in form.

8. A button attaching device according to claim 1 wherein the bifurcated member is of a resilient plastic material.

9. A button attaching device according to claim 1 wherein the arms are connected by material of the bifurcated member having a smaller cross sectional area than the cross sectional area of the arms.

10. A button attaching device according to claim 1 wherein the needle holding member is formed with a rounded end opposite the needle holding end to thereby prevent said member and the needles from standing vertically.

11. A button attaching device comprising a pair of needles for use in penetrating a layer of material and extending through the holes of a button to be attached to the material; a pair of substantially parallel arms each with one of the needles affixed in a free end portion to extend in the same general direction as the arm; a hinge connection between the arms which normally maintains a defined gap between the arms but permits said gap to be varied with the application of side pressure to the arms, and the spacing between the needles to be altered accordingly; and a cover for the needles positionable over said arms.

* * * * *